United States Patent [19]

Yie

[11] Patent Number: 4,945,688

[45] Date of Patent: Aug. 7, 1990

[54] NOZZLE FOR ENTRAINING ABRASIVE GRANULES WITHIN A HIGH PRESSURE FLUID JET AND PROCESS OF USING SAME

[75] Inventor: Gene G. Yie, Auburn, Wash.

[73] Assignee: Electric Power Research Institute, Inc., Palo Alto, Calif.

[21] Appl. No.: 790,053

[22] Filed: Oct. 22, 1985

[51] Int. Cl.[5] ..... B24C 5/04

[52] U.S. Cl. ..... 51/439; 51/438

[58] Field of Search ..... 51/439, 438, 427, 319, 51/320, 321; 299/17

[56] References Cited

U.S. PATENT DOCUMENTS

| | | | |
|---|---|---|---|
| 4,449,332 | 5/1984 | Griffiths | 51/439 |
| 4,478,368 | 10/1984 | Yie | 51/439 |

FOREIGN PATENT DOCUMENTS

| | | | |
|---|---|---|---|
| 0865377 | 3/1971 | Canada | 51/438 |
| 1059186 | 12/1983 | U.S.S.R. | 299/17 |
| 0166761 | 7/1921 | United Kingdom | 51/439 |

*Primary Examiner*—Robert Rose

*Attorney, Agent, or Firm*—Laurence Coit

[57] ABSTRACT

A high pressure fluid jet nozzle apparatus having a mixing chamber for entraining abrasive granules within a high pressure fluid jet. A plunger valve and a method for preventing wetting and caking of abrasive granules within a high pressure fluid jet nozzle are also disclosed.

2 Claims, 6 Drawing Sheets

Fig. 8
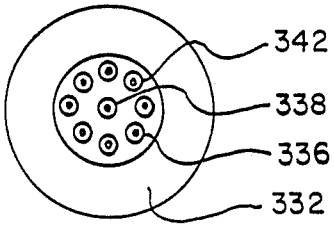
Fig. 7
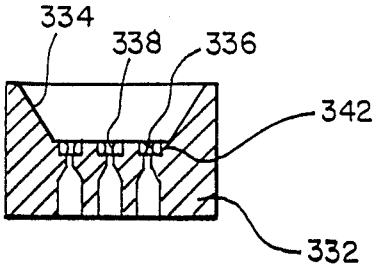
Fig. 11
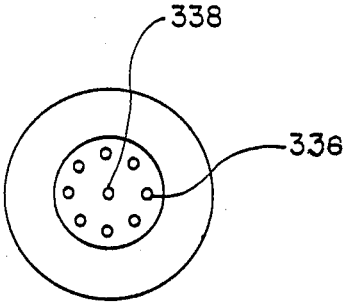
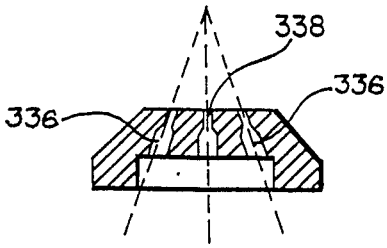
Fig. 10
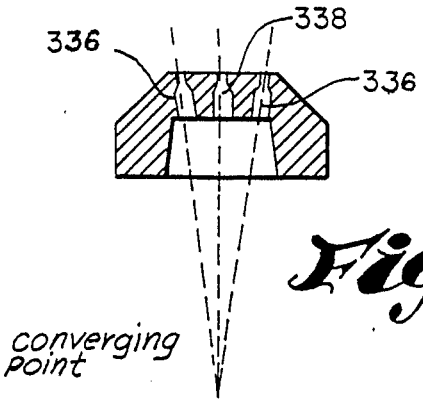
Fig. 9

NOZZLE FOR ENTRAINING ABRASIVE GRANULES WITHIN A HIGH PRESSURE FLUID JET AND PROCESS OF USING SAME

BACKGROUND OF THE INVENTION

1. Field of the Invention

The invention relates to high pressure fluid jet nozzle apparatus and in particular to a high pressure fluid jet nozzle having a means for entraining abrasive granules within a high pressure fluid jet and a means and method for preventing wetting and caking of the abrasive granules within the nozzle in the vicinity of the high pressure fluid jet.

2. Description of the prior art

It has been known that a fluid jet, generated by pressurizing a fluid, such as water, and directing such pressurized fluid through a suitable orifice, can cut a wide variety of materials. Such waterjets are currently in use commercially. It has been known also that the capability of such water jets in cutting hard materials can be greatly enhanced by introducing solid particulates, such as abrasives, into the jet stream to generate the so-called abrasive waterjet. In these abrasive waterjet processes, a key system component is the nozzle in which selected abrasives are introduced into the water stream. Many suitable abrasives for these processes are in the form of fine powder or dry granules that can cake up when wetted by fluid, thus blocking the flow. It would be desirable to have a high pressure fluid jet nozzle for entraining abrasive granules within a high pressure fluid jet such that the abrasive granules are kept dry within the nozzle in the vicinity of the high pressure fluid jet and thereby eliminate caking up and clogging of the nozzle at this location. This invention discloses a nozzle design that has an integrated check valve to prevent the wetting of dry abrasives prior to being mixed with the fluid stream. By virtue of this invention, the blockage of abrasive flow frequently encountered in abrasive waterjet processes can be avoided.

Another common problem experienced by nozzles of the prior art which admix abrasive granules with a high pressure fluid stream is erosive wear of the nozzle where the abrasive entrained high pressure fluid stream exits the nozzle. It would be desirable to have a high pressure fluid jet nozzle suitable for mixing abrasive granules with a high pressure fluid jet which will entrain the abrasive granules within the water jet to prevent extensive wear of the nozzle. It would also be desirable to have a high pressure fluid jet nozzle which will provide a predetermined pattern (including both converging and diverging) or multiple high pressure fluid streams to provide for cutting a corresponding kerf pattern.

SUMMARY OF THE INVENTION

Briefly, the present invention is a high pressure fluid jet nozzle for entraining abrasive granules within a high pressure fluid jet that reduces erosive wear of the nozzle cone or exit orifice of the nozzle. The nozzle of the invention accomplishes this by disposing an orifice cone having a predetermined orifice passage pattern in fluid communication with the high pressure fluid jet to provide a predetermined pattern of high pressure fluid streams defining an interior volume of ambient atmosphere such as for instance, defining a cylindrical wall pattern of high pressure fluid streams. When the predetermined pattern of high pressure fluid streams entrains the abrasive granules, a large portion of the abrasive granules move to the interior volume within the predetermined pattern of fluid streams. When this predetermined pattern of fluid streams with the entrained abrasive granules exit through a nozzle cone or other exit orifice of the nozzle, the large portion of the entrained abrasive granules do not inpinge upon or wear the exit orifice or nozzle. The predetermined orifice in preferred embodiments of the invention provides for both converging and diverging patterns of high pressure fluid streams to cut corresponding kerf patterns. The nozzle of the invention also includes a valve means for positive control of the abrasive granules disposed in proximity to the predetermined pattern of high pressure fluid streams to prevent wetting and caking of the abrasive granules. The valve means of the invention includes an operatable plunger biased to collapse a flexible abrasive conduit or otherwise block the flow of abrasive granules. A method of operation of the high pressure fluid jet nozzle of the invention that prevents caking of the abrasive granules and clogging of the nozzle is also disclosed.

BRIEF DESCRIPTION OF THE DRAWINGS

The invention may be better understood and further advantages and uses thereof more readily apparent when considered in view of the following detailed description of exemplary embodiments, taken in connection with the accompanying drawings, in which:

FIG. 7 is an enlarged cross sectional view of an orifice cone as may be used in FIG. 6 illustrating orifice passages and orifice disks inserted within each passage, respectively, to provide a predetermined pattern of high pressure fluid streams according to the teachings of the invention;

FIG. 8 is a top view of the orifice cone of FIG. 7 illustrating the, predetermined location of the orifice passages each having an orifice disk inserted therein;

FIG. 9 is a cross sectional view of an orifice cone to provide a converging pattern of high pressure fluid streams;

FIG. 10 is a cross sectional view of an orifice cone to provide a diverging pattern of high pressure fluid streams;

FIG. 11 is a top view of the orifice cone of either FIG. 9 or 10 illustrating the predetermined location of the orifice passages;

DESCRIPTION OF THE PREFERRED EMBODIMENTS

Figure 1:
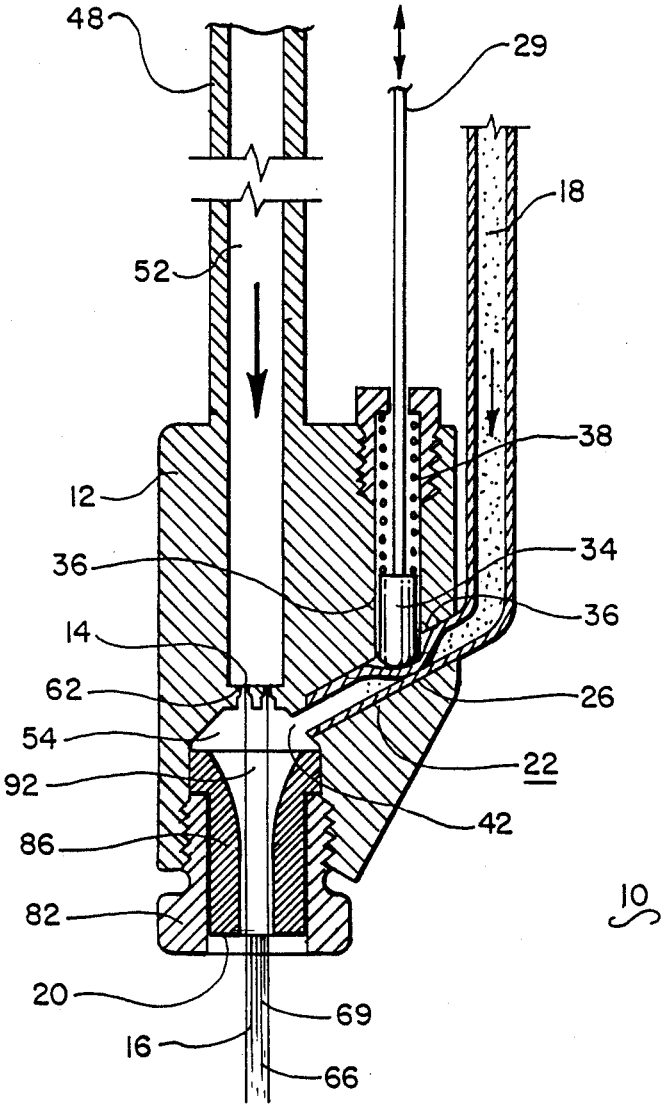
FIG. 1 is a cross-sectional view of an abrasive entrained high pressure fluid jet nozzle illustrating one embodiment of a valve means for preventing wetting and caking up of the abrasive granules, constructed according to the teachings of the invention.

Referring now to the drawings and to FIG. 1 in particular, there is shown a cross sectional view of a high pressure fluid jet nozzle 10, including nozzle body 12, having orifice means 14 for generating a predetermined pattern of high pressure fluid streams 16 suitable for entraining abrasive granules 18 to provide for reducing wear of exit cone 20 as high pressure fluid streams 16 with entrained abrasives 18 leave nozzle 10. High pressure fluid jet nozzle 10 further includes valve means 22 for preventing wetting and caking of abrasive granules 18 within nozzle 10. Still referring to FIG. 1 there is shown one embodiment of valve means 22 in which valve means 22 is actuated manually by operating cable 24. Dry abrasives 18 enter in nozzle 10 through flexible hose 26 which, for example, can be made of soft plastic or rubber. Flexible hose 26 extends into nozzle body 12 such that flexible hose 26 is in communication with plunger 34 which is located in plunger cavity 36 of nozzle body 12. Plunger 34 is biased by biasing means 38, which may be for example a helical spring, such that one end of plunger 34 compresses a predetermined portion of the side of flexible abrasive hose 26. The other end of plunger 34 is attached to cable 24 and abuts biasing means 38. Pulling cable 24 would compress or charge spring biasing means 38 and disengage plunger 34 from compressing the side of abrasive hose 26 thus opening abrasive passage 42. By manipulating operating cable 24, abrasive passage 42 may be opened or closed at will by an operator and fluid can be kept out of abrasive passage 42 completely. Since valve means 22 has no parts in contact with abrasive granules 18, it will last as long as the flexible abrasive hose 26, which for example may be made of natural or synthetic rubbers that are resistant to abrasives and are expected to have a long useful life.

Again referring to FIG. 1, nozzle body 12 is machined out of suitable metal or other wear resistant materials, and is adapted for connection to a source of high pressure fluid shown generally at 48. High pressure fluid jet nozzle 10 includes high pressure water chamber 52 and nozzle cavity 54 disposed within nozzle body 12. Orifice means 14 is disposed in nozzle cavity 54 and includes multiple water orifices 62 arranged in a predetermined pattern to generate a predetermined pattern of high pressure fluid streams 16 of desired characteristics.

The multiple high pressure fluid streams 14 define an interior volume 64 and an exterior volume 66 which exterior volume 68 is shrouded by exit cone 20 which conforms to the exterior volume 68 of the multiple high pressure fluid jet pattern. Exit cone 20 is held in place by nozzle support nut 82. Exit cone 20 has a tapered interior passage 86 conforming to the exterior shape of high pressure fluid stream 14 and is made of wear resistant materials, such as for example, carbide, ceramics or hardened steel. The interior cavity of exit cone 20 and orifice means 14 form mixing chamber 92 that is in communication with abrasive passage 42 entering into mixing chamber 92 at a suitable predetermined angle. Orifice means 14 will be described in further detail later in the detailed description of FIGS. 7 through 11.

Figure 2:
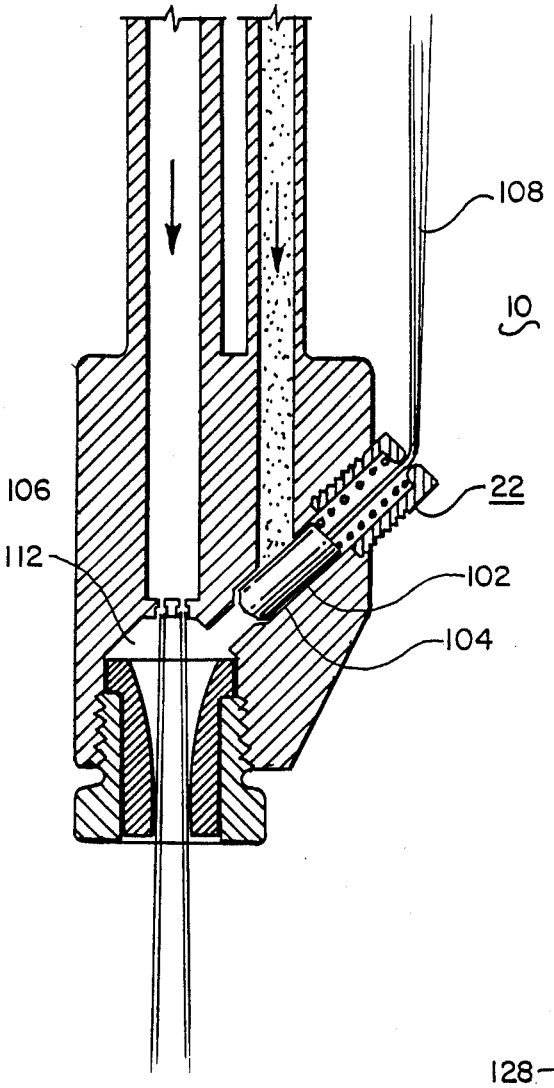
FIG. 2 is an abrasive entrained high pressure fluid jet nozzle for entraining abrasive granules within a predetermined pattern of high pressure fluid streams, constructed according to the teachings of the invention, illustrating a second embodiment of the valve means of the invention.

Referring now to FIG. 2 there is shown a cross sectional view of another embodiment of abrasive valve means 22 of the invention in which the abrasive valve means 22 is also operated with a cable and a spring loaded plunger. However now valve means 22 includes plunger 102 which again can be made of for example, wear resistant plastic, rubber, or metal. Plunger 102 is in direct contact with the abrasive flow and is sealed in a cylindrical plunger cavity 104 in direct communication with abrasive passage 106. By pulling the external cable 108, plunger 102 is moved away from its seated position within cylindrical plunger cavity 104, thus opening the abrasive passage to the mixing chamber 112.

Figure 3:
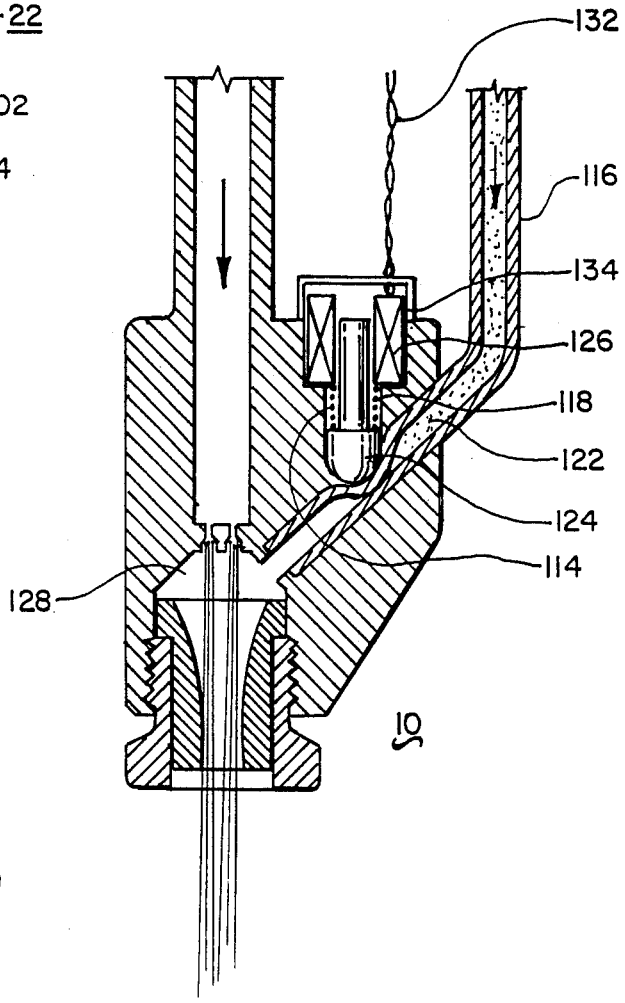
FIG. 3 is a cross sectional view of an abrasive entrained high pressure fluid jet nozzle constructed according to the teachings of the invention, illustrating another embodiment of the valve means of the invention.

Referring now to FIG. 3 there is shown a cross-sectional view of another embodiment of the abrasive valve means of the invention in which the abrasive valve means is actuated by means of solenoid operated plunger 114. Solenoid operated plunger 114 normally compresses flexible abrasive hose 116 by the action of spring biasing means 118 thus keeping moisture out of abrasive passage 122. Plunger 124 is made of magnetic materials such as for example, steel, and is surrounded by operating solenoid 126. Thus when solenoid 126 is energized, plunger 124 will move away from and disengage itself from flexible abrasive hose 116 thus allowing abrasive granules to be introduced into the mixing chamber 128. An electric cable 132 connects solenoid 124 to a power source and a control switch. Solenoid 126 is sealed off from environmental elements to ensure trouble free operation by means of, for example, plastic resin 134.

Figure 4:
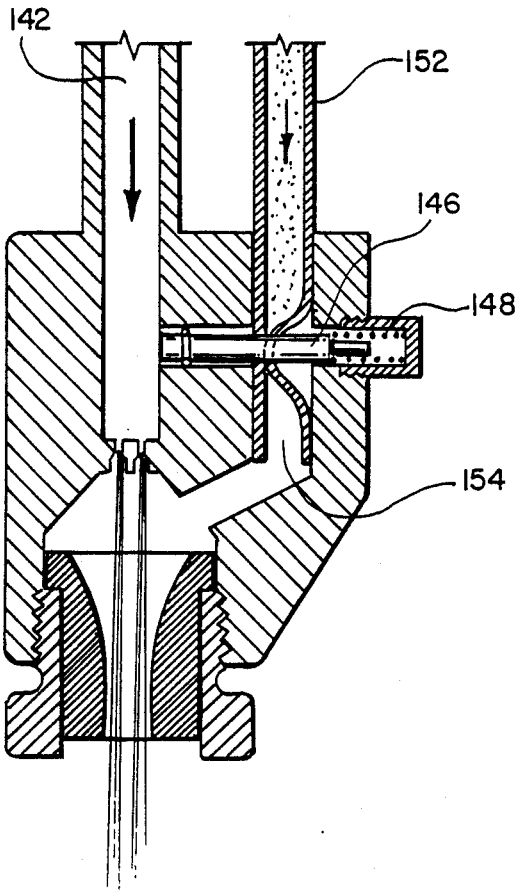
FIG. 4 is a cross sectional view of a high pressure fluid jet nozzle for entraining high pressure fluid streams with abrasive granules, constructed according to the teachings of the invention, illustrating a pressure activated embodiment of the valve means of the invention.

Referring now to FIG. 4 there is shown a cross-sectional view of still another embodiment of the abrasive valve means of the invention in which the abrasive valve means is actuated by the water pressure inside the high pressure chamber 142 of high pressure fluid jet nozzle 144 through a sliding plunger 146. When the fluid pressure is interrupted biasing means spring 148 pushes plunger 146 toward high pressure chamber 142 and pinches flexible abrasive hose 152 thus closing abrasive passage 154. When the fluid pressure is turned on, high pressure fluid pushes plunger 146 compressing biasing means spring 148, thus relieving pressure on the side of abrasive hose 152 to restore passage 154.

Figure 5:
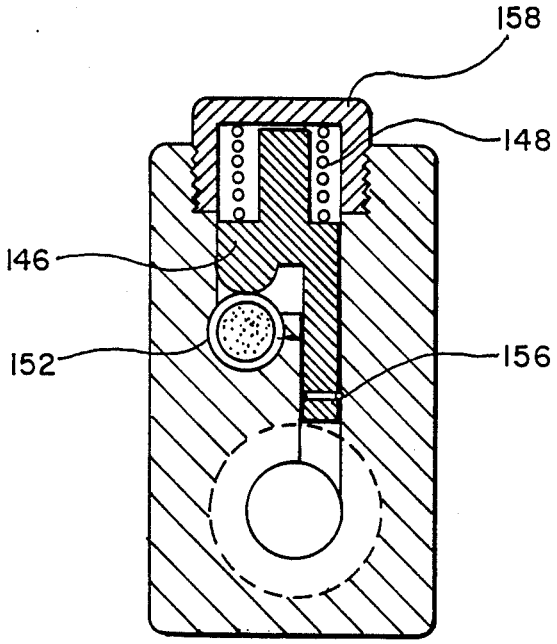
FIG. 5 is a top view of the high pressure fluid jet nozzle of FIG. 4 illustrating the pressure actuated valve means of the invention.

Referring now to FIG. 5 there is shown a top cross sectional view of this fluid actuated abrasive valving means of FIG. 4 illustrating the shape of sliding plunger 146 and how it impinges on the flexible abrasive hose 152. One end of plunger 146 is in contact with flexible abrasive hose 152 and is in the shape of a half sphere sized to fit abrasive hose 152. By action of the biasing means spring 148, flexible abrasive hose 152 can be completely closed to keep moisture out of abrasive passage 154. Sliding plunger 146 has an o-ring seal 156 at one end and is stopped by retainer 158 at the other end. Thus the movement of sliding plunger 146 is confined within the range necessary for opening and closing flexible abrasive hose 152. 0-ring seal 156 keeps the high pressure fluid sealed within the high pressure chamber. The diameter of plunger 146 and the force of biasing spring 148 are designed according to the high pressure fluid encountered such that positive opening of the flexible abrasive hose 152 is ensured as soon as the fluid pressure inside the high pressure chamber reaches a predetermined level. This fluid actuated abrasive valving means has the advantage of being automatic, requiring no manipulation from an operator. This automatic valving means allows the abrasive valving means to open automatically when the water pressure is turned on and to close when the water pressure is turned off, thus preventing water from entering into the abrasive line and eliminating the possibility of human error in operating manual valves. This valve can be incorporated with an integral electrical switch which can be used to operate an abrasive dispensing system.

Figure 6:
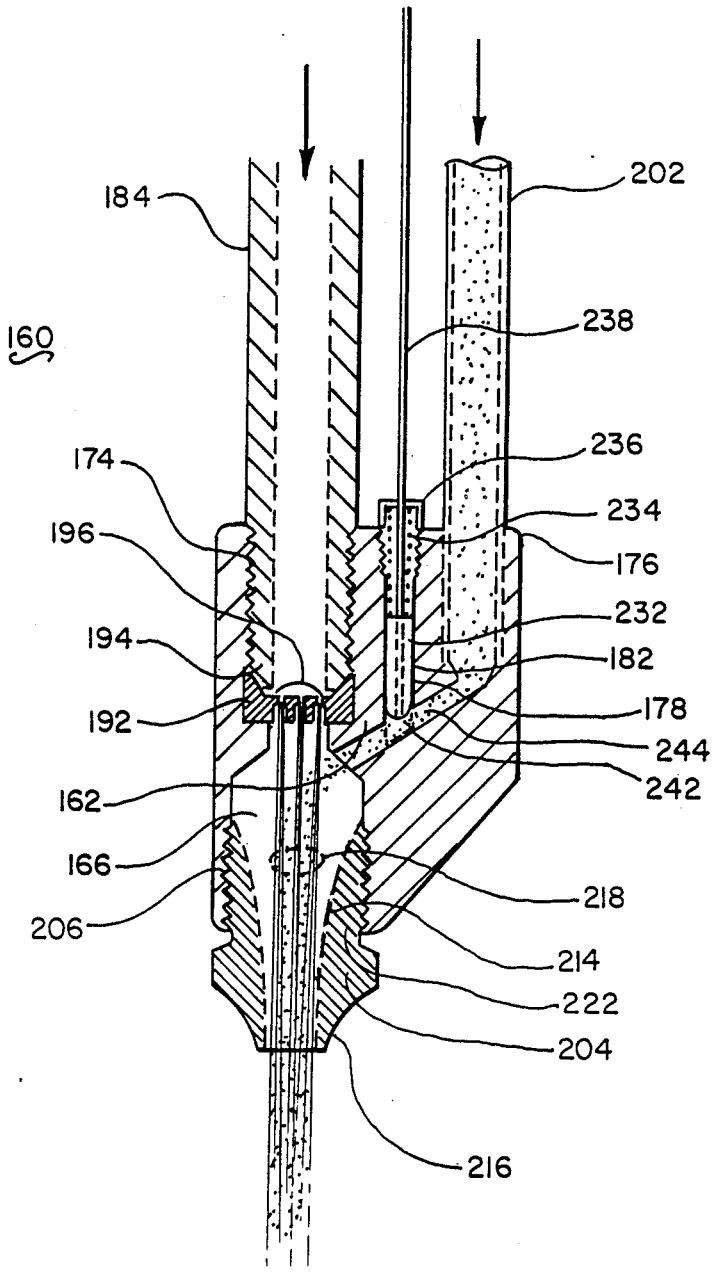
FIG. 6 is a cross sectional view of a high pressure fluid jet nozzle constructed according to the teachings of the invention illustrating the orifice means for entraining the abrasive granules within a predetermined pattern of high pressure fluid streams according to the teachings of the invention.

Referring now to FIG. 6 there is shown a cross-sectional view of high pressure fluid jet nozzle 160 illustrating in detail orifice means 162 for generating a predetermined pattern of high pressure fluid streams 164 according to the teachings of the invention. High pressure fluid nozzle 160 includes nozzle body 172 having a cylindrical through passage 174 an abrasive inlet 176 and a cylindrical cavity 178 for housing an abrasive valve means 182. The upper end of cylindrical through passage 174 is connected to a high pressure tube 184 through which pressurized fluid is transported from high pressure tube 184 to orifice means 162. Orifice means 162 includes orifice cone 192 having tapered surfaces 194 which mate with one end of high pressure tube 184. Orifice cone 192 has multiple high precision orifices 196 and is sealed against nozzle body 172. Below orifice cone 192 and inside through passage 174 of nozzle body 172 is a mixing cavity 198 in which abrasive particles enter through abrasive passage 244. A nozzle cone 204 made of wear resistant materials is inserted into the other end of the cylindrical through passage 174 at 206 Nozzle cone 204 has a tapered interior passage to form a throat 214 at the exit and also has a tapered exterior tip 216. The diameter of the bore of the throat is just slightly larger than the diameter of the jet bundle (high pressure fluid steams) 218 issued by the multiple orifice cones 196 at the location of the nozzle cone 204 which has threads 222 to allow for adjustment of its axial position along the fluid jet bundle. Abrasive valve means 182 of the invention consists of a plunger 232, a spring 234, a cap 236, and a cable 238. The plunger 232 is normally seated at a lower position 242 shown drawing in phantom in FIG. 6, thus closing the abrasive passage 244, by the force of the spring 234. When the cable 238 is pulled, the plunger 232 is lifted to open the abrasive passage 244. By virtue of this abrasive valve means 182, the fluid can be kept out of the abrasive passage 244, thus avoiding blockage of this passage, as explained earlier with reference to FIGS. 1 through 5.

Referring now to FIG. 7 there is shown a cross sectional view of another embodiment of orifice means 192 of this invention. Orifice cone 332 has a concave sealing surface 334 for mating with high pressure tubing and nine orifices arranged so eight orifices 336 are placed in a circular pattern while the ninth orifice 338 is situated at the center. Inserted into the nine orifices are seperate orifice disk 342 made of very hard materials such as saphire, ruby, hard ceramics, tungsten carbide, boron carbide, or hardened steel. The orifice disk 342 are mounted in recesses drilled into the stainless steel orifice cone and are positioned to issue fluid jets that are parallel to each other.

Referring now to FIG. 8 there is shown a top view of the orifice of FIG. 7 illustrating the predetermined location of the orifice passages.

Referring now to FIG. 9 and 10 there are shown other embodiments of orifice means 192 constructed according to the teachings of the invention and in FIG. 11 there is a top view of both. FIGS. 9 and 10 illustrates that the orifice passages 336 may be disposed at predetermined angles to provide either converging point high pressured fluid jet streams (FIG. 9), or diverging point high pressure fluid jet streams (FIG. 10).

Figure 12:
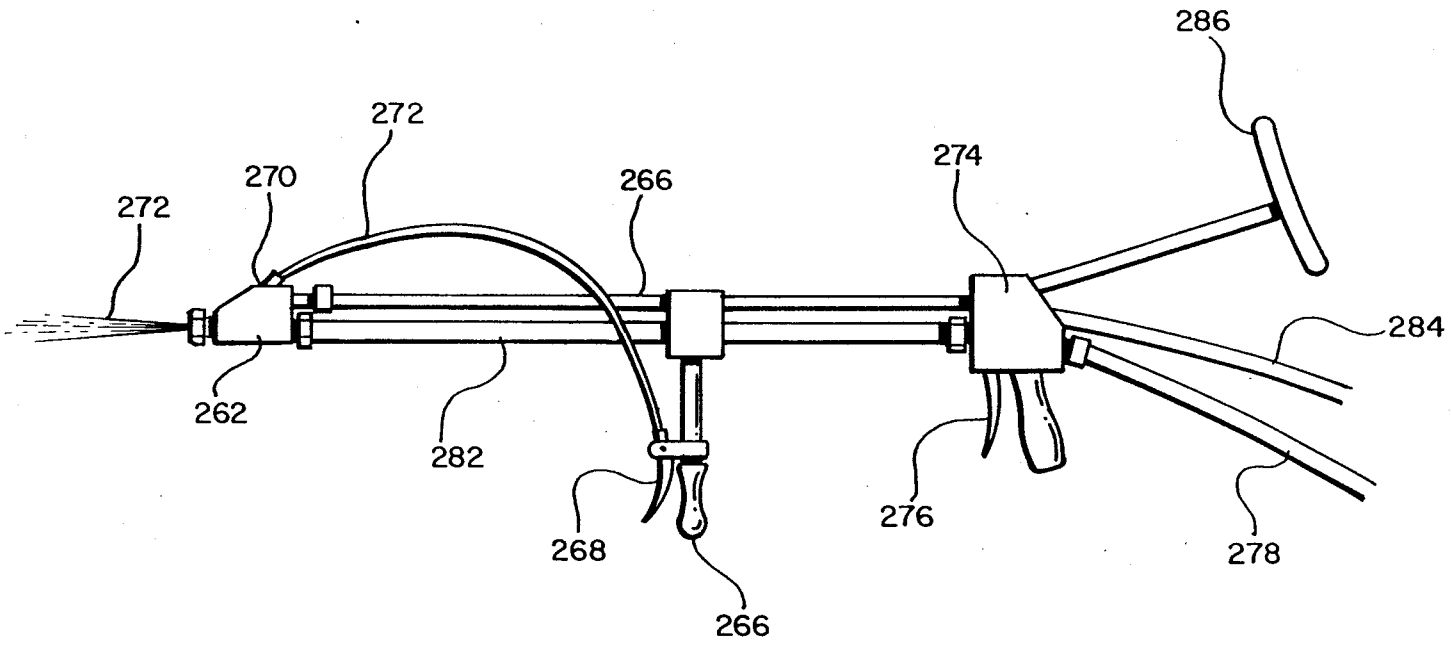
FIG. 12 is an elevational view of a hand held apparatus utilizing the abrasive entrained high pressure fluid jet nozzle of the invention.

Referring now to FIG. 12 there is shown an elevational view of a hand held tool 260 utilizing the abrasive entrained high pressure fluid jet nozzle of this invention. Tool 260 includes high pressure fluid jet nozzle 262 suitable for entraining abrasives within a predetermined high pressure fluid jet stream pattern such as that shown at 264. Hand held tool 260, further includes handle 266, abrasive valve trigger 268, and operating cable 272, all suitable for operating check valve means 270 for preventing wetting and caking of abrasive granules within nozzle 262 as herein before described. Hand held tool 260 further includes fluid valve 274 and fluid valve trigger 276, suitable for opening and interrupting the fluid flow from high pressure fluid hose 278 into high pressure fluid tube 282. Hand held tool 260 further includes abrasive hose 284 and shoulder support 286. In operation fluid valve trigger 276 is first depressed to allow passage of high pressure fluid from high pressure fluid hose 278 through high pressure fluid tube 282 into abrasive entrained high pressure fluid jet nozzle 262. Secondly, abrasive valve trigger 268 is depressed to allow passage of abrasive granules through check valve means 270, in order to allow the abrasive granules to be entrained within predetermined water jet pattern 264. To stop operating hand held tool 260, first abrasive valve trigger 268 is released thereby interrupting passage of the source of abrasive granules by means of check valve means 270 into high pressure water jet nozzle 262 and secondly fluid valve trigger 276 is released to interrupt passage of high pressure fluid into high pressure fluid jet nozzle body 262. If a pressure activated check valve means as described in FIGS. 4 and 5 were incorporated in hand held tool 10 as depicted in FIG. 12, then of course abrasive valve handle 266 and abrasive valve trigger 268 as well as operating cable 272 would be eliminated because check valve means 270 would now be operated by the fluid pressure within high pressure jet nozzle body 262 In such were the case, during the method of operation described above, the opening of the passages of high pressure fluid and the abrasive granules would occur simultaneously as would the interruption of the passage of the abrasive granules and the high pressure fluid. By sequentially operating these two valves, water can be kept out of the abrasive passage completely even if this tool were held at an unfavorable angle.

In conclusion the teachings of the invention include a check valve means for keeping water out of the abrasive passage of an abrasive high pressure water jet nozzle, and an orifice means for generating a predetermined pattern of high pressure fluid streams having an interior and exterior volume for entraining abrasive granules in the interior volume to eliminate or greatly reduce nozzle wear. The check valve means, according to the teachings of the invention, could potentially be used in various forms, depending upon the mechanism of actuation, several embodiments having been illustrated infra.

I claim:

1. A high pressure water jet nozzle for entraining an abrasive material within a high pressure water jet, comprising:

(a) A nozzle body adapted for fluid communication with a high pressure fluid and a source of abrasive materials;

(b) orifice means disposed in said nozzle body so as to be in fluid communication with said high pressure fluid for dividing said high pressure fluid into a predetermined pattern of smaller high pressure fluid streams; and (c) an orifice cone disposed within said nozzle body so as to be in fluid communication with said high pressure fluid, said orifice cone having orifice passages disposed therethrough at predetermined locations to provide said predetermined pattern of high pressure fluid streams, said orifice passages are disposed within said orifice cone to provide a converging pattern of high pressure fluid streams, said converging pattern of high pressure fluid streams converging at a predetermined point external to said water jet nozzle to provide for a converging shaped cut in or through a workpiece.

2. A high pressure water jet nozzle for entraining an abrasive material within a high pressure water jet, comprising:

(a) a nozzle body adapted for fluid communication with a high pressure fluid and a source of abrasive materials;

(b) orifice means disposed in said nozzle body so as to be in fluid communication with said high pressure fluid for dividing said high pressure fluid into a predetermined pattern of smaller high pressure fluid stream; and (c) an orifice cone disposed within said nozzle body so as to be in fluid communication with said high pressure fluid, said orifice cone having orifice passages disposed therethrough at predetermined locations to provide said predetermined pattern of high pressure fluid streams, said orifice passages are disposed within said orifice cone to provide a diverging pattern of high pressure fluid streams, said diverging pattern of high pressure fluid steams diverging to a predetermined width at a predetermined point external to said water jet nozzle to provide for a diverging shaped cut in or through a workpiece.

* * * * *